US009701443B2

(12) United States Patent
Wang

(10) Patent No.: US 9,701,443 B2
(45) Date of Patent: Jul. 11, 2017

(54) SET OF STACKABLE TOOL BOXES

(71) Applicant: Compass Corporation, Tainan (TW)

(72) Inventor: Tzu-Chien Wang, Tainan (TW)

(73) Assignee: COMPASS CORPORATION, Tainan (TW)

( * ) Notice: Subject to any disclaimer, the term of this patent is extended or adjusted under 35 U.S.C. 154(b) by 35 days.

(21) Appl. No.: 14/930,620

(22) Filed: Nov. 2, 2015

(65) Prior Publication Data

US 2017/0121056 A1 May 4, 2017

(51) Int. Cl.
*B65D 21/032* (2006.01)
*B65D 21/02* (2006.01)

(52) U.S. Cl.
CPC ..... *B65D 21/0228* (2013.01); *B65D 21/0204* (2013.01)

(58) Field of Classification Search
CPC ..... B65D 21/0228; B65D 21/0204; B65D 21/0209; E05C 19/022; E05C 19/06; E05C 19/063; E05C 19/066
USPC ..... 292/80, 81, 85, 87, 89; 206/501, 504
See application file for complete search history.

(56) References Cited

U.S. PATENT DOCUMENTS 5,301,829 A * 4/1994 Chrisco ..... B65D 21/0228 206/216
5,427,265 A * 6/1995 Cautereels ..... A45C 11/20 16/260
8,602,217 B2 * 12/2013 Sosnovsky ..... B25H 3/021 206/503
2011/0139777 A1 * 6/2011 Sosnovsky ..... B25H 3/021 220/23.83

* cited by examiner

*Primary Examiner* — Stephen Castellano

(57) ABSTRACT

A toolbox includes a space for receiving tools and includes a peripheral side and top and bottom sides. The peripheral side includes at least one snap fastener on an upper end thereof and at least one engagement portion on a lower end thereof. The at least one snap fastener includes a flexible engagement plate. A hook is formed on an upper end of the engagement plate. The lower end of the engagement plate can be pressed to move the hook away from the peripheral side of the toolbox. The hook of the at least one snap fastener of the toolbox can engage with at least one engagement portion of another similarly constructed toolbox stacked above the toolbox. The at least one engagement portion of the toolbox can engage with a hook of at least one snap fastener of another similarly constructed toolbox stacked below the toolbox.

2 Claims, 8 Drawing Sheets

A - A

B - B

SET OF STACKABLE TOOL BOXES

BACKGROUND OF THE INVENTION

The present invention relates to a toolbox and, more particularly, to a toolbox that can be stacked and positioned on another similarly constructed toolbox while reducing the elements and permitting easy engagement and positioning during operation.

Similar tools are generally placed in the same toolbox for easy management, and tools of different types or sizes are placed in other toolboxes. However, a user has to carry many toolboxes when tools to be used are received in different toolboxes. Although the toolboxes can be stacked to reduce the volume, the toolboxes are apt to topple over when the overall center of gravity becomes unstable during carriage.

To avoid the above disadvantage, a hook is pivotably mounted to a lateral side of the lower toolbox, and a groove for engaging with the hook is formed in a lateral side of the upper toolbox, such that the hook is engaged in the groove when the upper and lower toolboxes are stacked, preventing the upper toolbox from falling due to rocking during carriage.

However, the upper toolbox must be firstly placed on top of the lower toolbox before pivoting the hook to engage with the groove, which is inconvenient to operation. Furthermore, the hook is a separate element pivotably mounted to the toolbox and, thus, increases the costs.

BRIEF SUMMARY OF THE INVENTION

An objective of the present invention is to provide a toolbox with fewer elements and permitting easy engagement and positioning during operation.

In a first aspect, a toolbox includes a space adapted for receiving tools. The toolbox includes a peripheral side and top and bottom sides. The peripheral side includes at least one snap fastener on an upper end thereof and at least one engagement portion on a lower end thereof. The at least one snap fastener includes an engagement plate. A hook is formed on an upper end of the engagement plate and protrudes towards the peripheral side. The hook includes a top having an inclined guiding face and a bottom having a hooking face. A connecting plate is provided on an intermediate portion of an inner face of the engagement plate and is connected to the peripheral side. The engagement plate is spaced from the peripheral side and is flexible about the connecting plate. The engagement plate further includes a lower end having a pressing portion. The pressing portion is adapted to be pressed to move the hook away from the peripheral side of the toolbox. The at least one engagement portion includes an engagement edge protruding away from the toolbox. The hook face of the hook of the at least one snap fastener of the toolbox is adapted to engage with an engagement edge of at least one engagement portion of another similarly constructed toolbox stacked above the toolbox. The engagement edge of the at least one engagement portion of the toolbox is adapted to engage with a hook face of a hook of at least one snap fastener of another similarly constructed toolbox stacked below the toolbox.

In an example, the toolbox is a parallelepiped including two lateral sides, two parallel sides, and the top and bottom sides. The peripheral side includes the two lateral sides and the two parallel sides. The at least one snap fastener and the at least one engagement portion are provided on each of the two lateral sides. The hook of the at least one snap fastener extends upwards beyond the top side of the toolbox. The at least one engagement portion extends downwards beyond the bottom side of the toolbox.

The top side of the toolbox can be slightly lower than a top edge of the peripheral side of the toolbox and can include a recess. The peripheral side can include at least one abutment portion protruding inwards from the top edge thereof. The bottom side of the toolbox can include at least one protrusion protruding downwards away from the bottom side and having a length in a vertical direction substantially equal to a length of the at least one engagement portion in the vertical direction. The at least one protrusion of the toolbox can be received in a recess of another similarly constructed toolbox stacked below the toolbox and can abut the top side of the another similarly constructed toolbox stacked below the toolbox. The at least one abutment portion of the toolbox can abut a bottom side of another similarly constructed toolbox stacked above the toolbox.

In a second aspect, a toolbox set includes a plurality of toolboxes. Each of the plurality of toolboxes includes a space adapted for receiving tools. Each of the plurality of toolbox includes two lateral sides, two longitudinal sides, and top and bottom sides. Each of the two lateral sides includes at least one snap fastener on an upper end thereof and at least one engagement portion on a lower end thereof. The at least one snap fastener includes an engagement plate. A hook is formed on an upper end of the engagement plate and protrudes towards one of the two lateral sides. The hook includes a top having an inclined guiding face and a bottom having a hooking face. A connecting plate is provided on an intermediate portion of an inner face of the engagement plate and is connected to the one of the two lateral sides. The engagement plate is spaced from the one of the two lateral sides and is flexible about the connecting plate. The engagement plate further includes a lower end having a pressing portion. The pressing portion is adapted to be pressed to move the hook away from a corresponding one of the two lateral sides of the toolbox. The at least one engagement portion includes an engagement edge protruding away from the toolbox. The hook face of the hook of the at least one snap fastener of one of the plurality of toolboxes is adapted to engage with an engagement edge of at least one engagement portion of another of the plurality of toolboxes stacked above the one of the plurality of toolboxes. The engagement edge of the at least one engagement portion of one of the plurality of toolboxes is adapted to engage with a hook face of a hook of at least one snap fastener of another of the plurality of toolboxes stacked below the one of the plurality of toolboxes.

An upper toolbox can have a size smaller than a size of a lower toolbox.

In a third aspect, a toolbox set includes a first toolbox and two second toolboxes. Each of the first toolbox and the two second toolboxes includes a space adapted for receiving tools. Each of the first toolbox and the two second toolboxes includes two lateral sides, two longitudinal sides, and top and bottom sides. Each of the two longitudinal sides of each of the two second toolboxes has a length equal to a length of each of the two lateral sides of the first toolbox. Each of the two lateral sides of each of the two second toolboxes has a length equal to a half of a length of each of the two longitudinal sides of the first toolbox.

Each of the two lateral sides of the first toolbox includes two first snap fasteners on an upper end thereof and two first engagement portions on a lower end thereof. Each of the longitudinal sides of each of the two second toolboxes includes two second snap fasteners on an upper end thereof and two second engagement portions on a lower end thereof.

Each of the two first snap fasteners and the two second snap fasteners includes an engagement plate. A hook is formed on an upper end of the engagement plate and protrudes towards a corresponding one of the two lateral boxes of the first toolbox or a corresponding one of the two longitudinal sides of one of the two second toolboxes. The hook includes a top having an inclined guiding face and a bottom having a hooking face. A connecting plate is provided on an intermediate portion of an inner face of the engagement plate and is connected to a corresponding one of the two lateral sides of the first toolbox or a corresponding one of the two longitudinal sides of one of the two second toolboxes. The engagement plate is spaced from a corresponding one of the two lateral boxes of the first toolbox or a corresponding one of the two longitudinal sides of one of the two second toolboxes and is flexible about the connecting plate. The engagement plate further includes a lower end having a pressing portion. The pressing portion is adapted to be pressed to move the hook away from a corresponding one of the two lateral sides of the first toolbox or a corresponding one of the two longitudinal sides of one of the two second toolboxes. Each of the two first engagement portions and the two second engagement portions includes an engagement edge protruding away from a corresponding one of the first toolbox or a corresponding one of the two second toolboxes.

The two second toolboxes are stacked on the first toolbox. The hook face of the hook of each of the two first snap fasteners of the first toolbox engages with the engagement edge of one of the two second engagement portions of one of the two second toolboxes stacked above the first toolbox. Two adjacent lateral sides of the two second toolboxes abut each other.

The toolbox set can further include four third toolboxes. Each of the four third toolboxes includes a space adapted for receiving tools. Each of the four third toolboxes includes two lateral sides, two longitudinal sides, and top and bottom sides. Each of the two longitudinal sides of each of the four third toolboxes has a length equal to the length of each of the two lateral sides of each of the two second toolboxes. Each of the two lateral sides of each of the four third toolboxes has a length equal to a half of the length of each of the two lateral sides of each of the two second toolboxes.

Each of the two lateral sides of each of the four third toolboxes includes a third snap fastener on an upper end thereof and a third engagement portion on a lower end thereof. Each third snap fastener includes an engagement plate. A hook is formed on an upper end of the engagement plate of each third snap fastener and protrudes towards a corresponding one of the two lateral boxes of one of the four third toolboxes. The hook of each third snap fastener includes a top having an inclined guiding face and a bottom having a hooking face. A connecting plate is provided on an intermediate portion of an inner face of the engagement plate of each third snap fastener and is connected to a corresponding one of the two lateral sides of one of the four third toolboxes. The engagement plate is spaced from a corresponding one of the two lateral boxes of one of the four third toolboxes. The engagement plate of each third snap fastener further includes a lower end having a pressing portion. The pressing portion of each third snap fastener is adapted to be pressed to move the hook of the third snap fastener away from a corresponding one of the two lateral sides of one of the four third toolboxes. Each of the two engagement portions includes an engagement edge protruding away from the toolbox.

Two of the four toolboxes are stacked on one of the two second toolboxes. Two adjacent longitudinal sides of the two of the four toolboxes abut each other. Another two of the four toolboxes are stacked on the other second toolbox. Two adjacent longitudinal sides of the another two of the four toolboxes abut each other. The hook face of the hook of each of the two second snap fasteners of each of the two second toolboxes engages with the engagement edge of the engagement portion of one of the four third toolboxes.

The present invention will become clearer in light of the following detailed description of illustrative embodiments of this invention described in connection with the drawings.

DESCRIPTION OF THE DRAWINGS

FIG. 1A is an enlarged view of a circled portion of FIG. 1.

FIG. 6A is an enlarged view of a circled portion of FIG. 6.

DETAILED DESCRIPTION OF THE INVENTION

Figure 1:
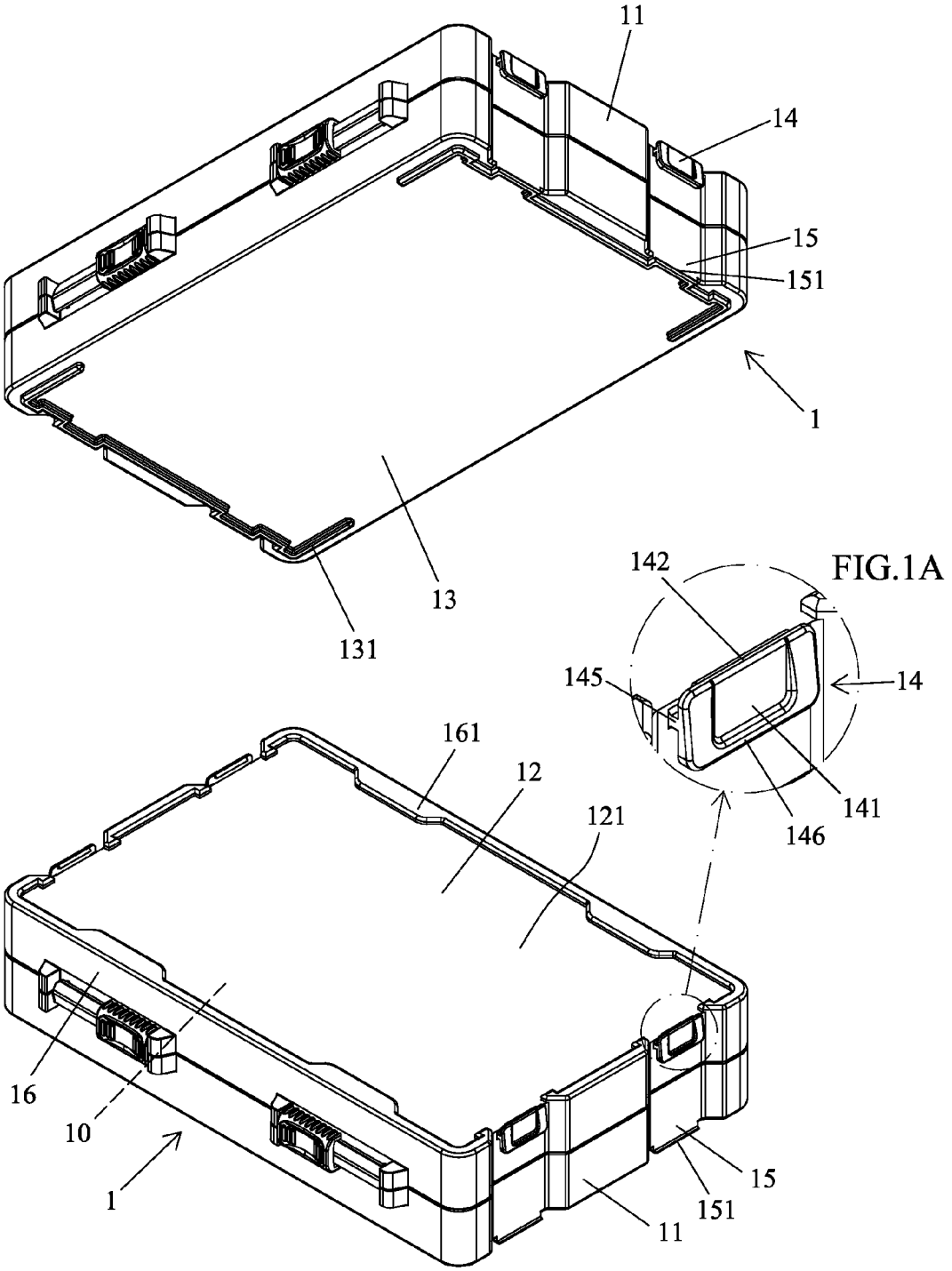
FIG. 1 is a perspective view of two toolboxes according to the present invention before stacking.
Figure 2:
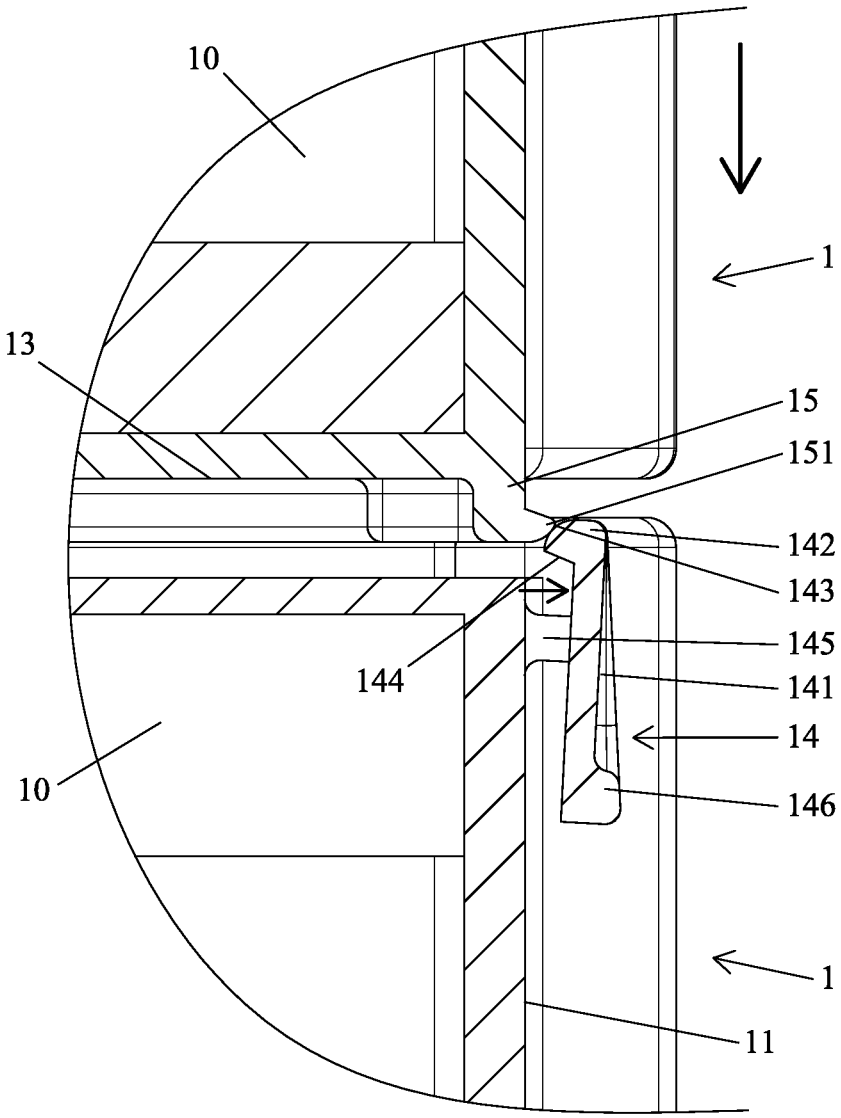
FIG. 2 is an enlarged cross sectional view illustrating coupling between the two stacked toolboxes.

With reference to FIGS. 1 and 2, a first toolbox 1 according to the present invention is a parallelepiped and includes a space 10 for receiving tools. FIGS. 1 and 2 show two first toolboxes 1 of the same size. The first toolbox 1 includes two lateral sides 11 opposite to each other and two longitudinal sides 16 extending between the lateral sides 11. Each longitudinal side 16 has a length larger than a length of each lateral side 11. The first toolbox 1 further includes top and bottom sides 12 and 13. Each lateral side 11 includes two snap fasteners 14 on an upper end thereof and two engagement portions 15 on a lower end thereof. As shown in FIGS. 1A and 2, each snap fastener 14 includes an engagement plate 141. A hook 142 is formed on an upper end of the engagement plate 141 of each snap fastener 14 and protrudes towards a corresponding lateral side 11. The hook 142 of each snap fastener 14 includes a top having an inclined guiding face 143 and a bottom having a hooking face 144. A connecting plate 145 is provided on an intermediate portion of an inner face of the engagement plate 141 of each snap fastener 14 and is connected to the corresponding lateral side 11. The engagement plate 141 of each snap fastener 14 is substantially parallel to and spaced from the corresponding lateral side 11 and can flex about the connecting plate 145. The engagement plate 141 of each snap fastener 14 further includes a lower end having a pressing portion 146 for unlocking purposes. Each engagement portion 15 extends downwards beyond the bottom side 13 of the toolbox 1 and includes an engagement edge 151 protruding away from the toolbox 1 for engaging with the hook 142 of one of the snap fastener 14 of another similarly constructed first toolbox 1.

The top side 12 of the first toolbox 1 is slightly lower than the top edges of the lateral sides 11 and the longitudinal sides 16 and includes a recess 121. Each longitudinal side 16 includes at least one abutment portion 161 protruding inwards from the top edge thereof towards a central portion of the top side 12. The bottom side 13 of the first toolbox 1 includes at least one protrusion 131 protruding downwards away from the bottom side 13 and having a length in a vertical direction substantially equal to a length of each engagement portion 15 in the vertical direction, such that the first toolbox 1 can be placed flat on a horizontal plane.

Figure 3:
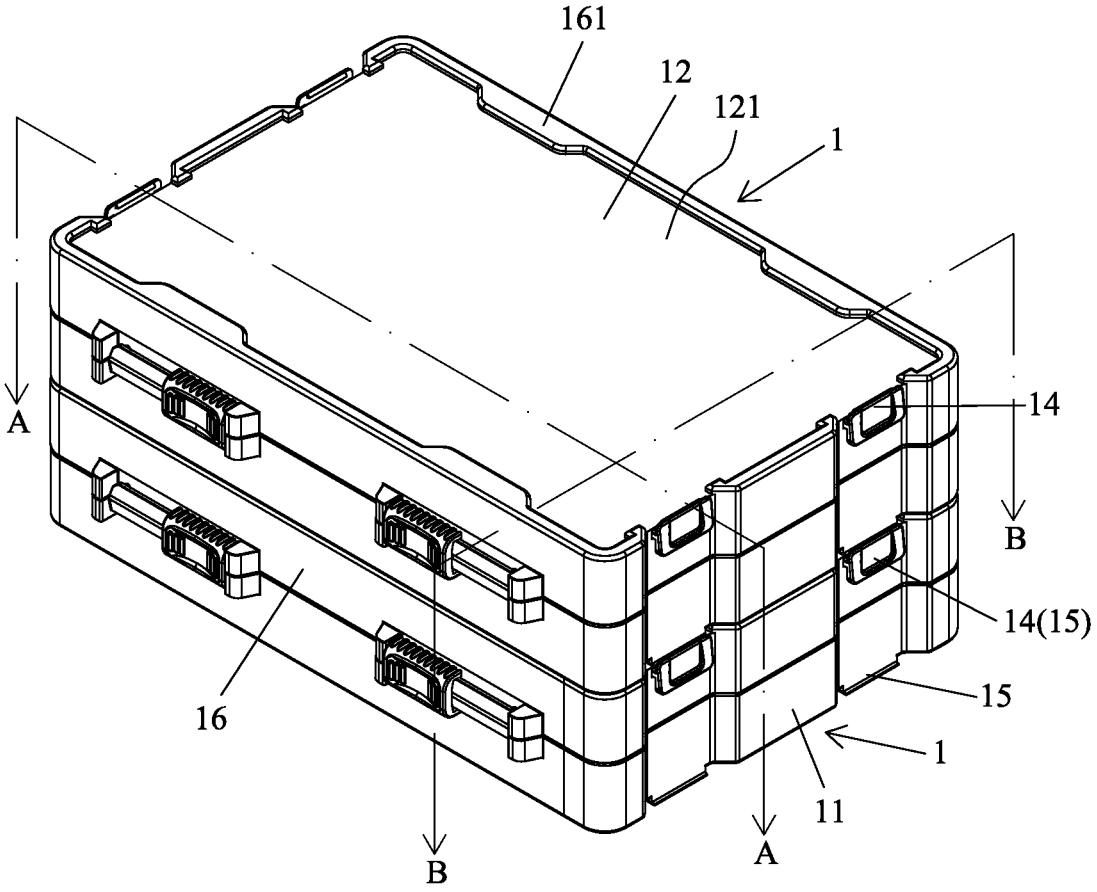
FIG. 3 is a perspective view of the two toolboxes of FIG. 1 after stacking.
Figure 4A:
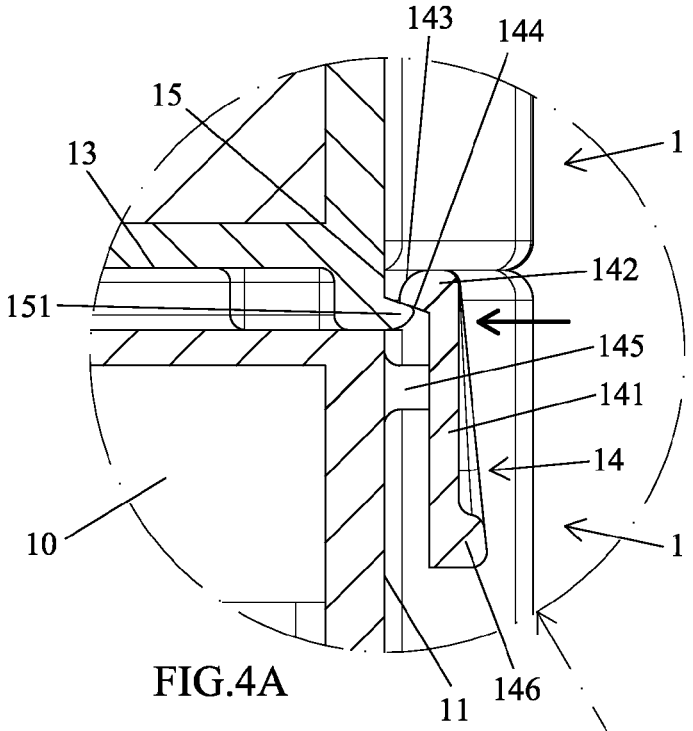
FIG. 4A is an enlarged view of a circled portion of FIG. 4.
Figure 4:
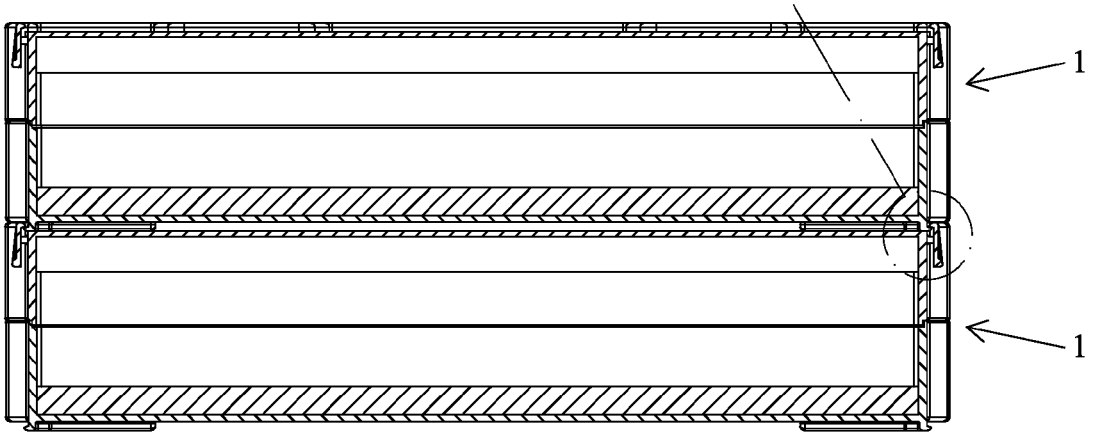
FIG. 4 is a cross sectional view taken along section line A-A of FIG. 3.
Figure 5A:
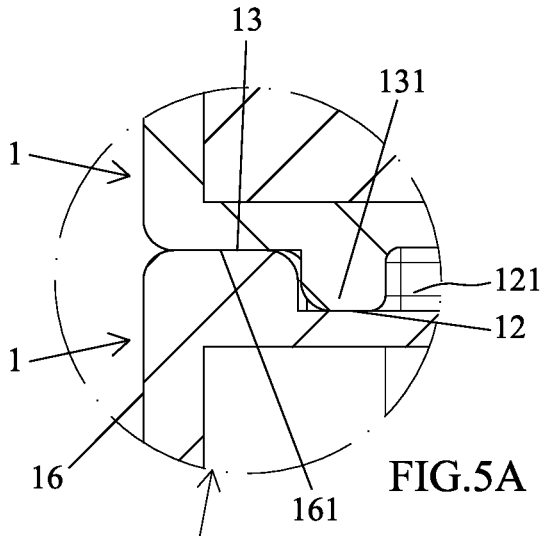
FIG. 5A is an enlarged view of a circled portion of FIG. 5.
Figure 5:
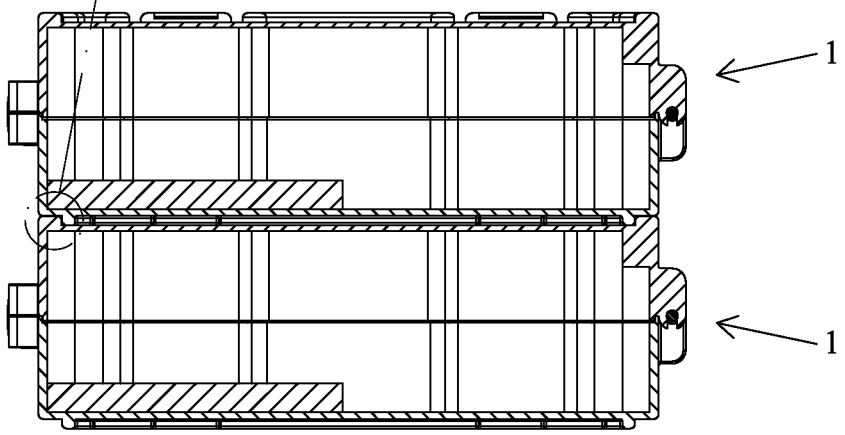
FIG. 5 is a cross sectional view taken along section line B-B of FIG. 3.

When stacking two first toolboxes 1, the upper first toolbox 1 is moved downwards towards the lower first toolbox 1. As shown in FIG. 2, the engagement edge 151 of each engagement portion 15 of the upper first toolbox 1 presses against the inclined guiding face 143 of one of the engagement plates 141 of the lower toolbox 1 and causes outward movement of the upper end of the engagement plate 141. With reference to FIGS. 3-5, after the upper first toolbox 1 is stacked on the lower first toolbox 1, due to the flexibility of the connecting plate 145 of each snap fastener 14 of the lower first toolbox 1, the hooking face 144 of each hook 142 of the lower first toolbox 1 engages with the engagement edge 151 of one of the engagement portions 15 of the upper first toolbox 1. After stacking, the bottom side 13 of the upper first toolbox 1 abuts the at least one abutment portion 161 of the lower first toolbox 1, and the at least one protrusion 131 of the toolbox 1 is received in the recess 121 of the top side 12 of the lower first toolbox 1 and abuts the top side 12, increasing the stacking stability (see FIGS. 4A and 5A).

Figure 6:
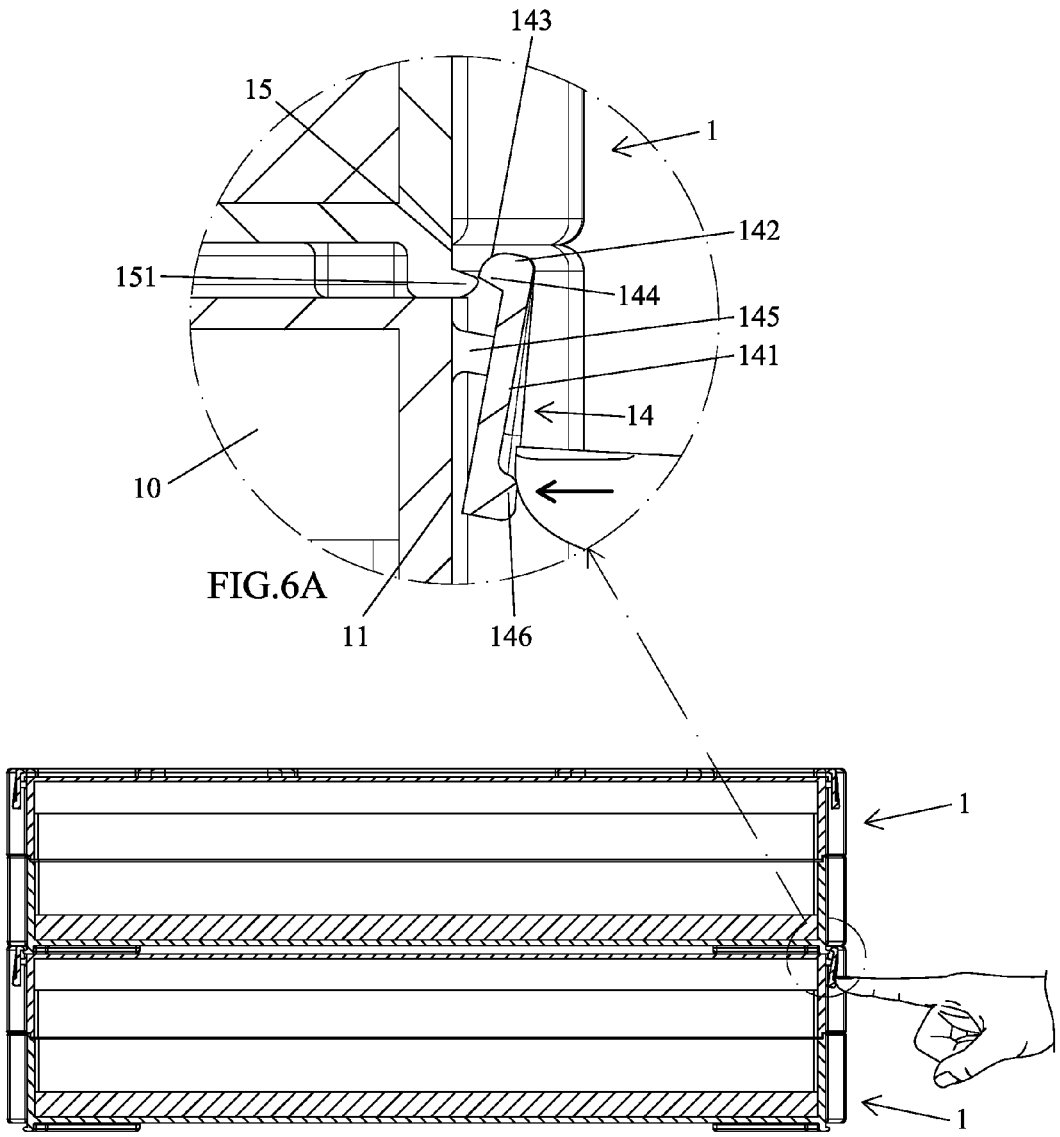
FIG. 6 is a view similar to FIG. 4, illustrating unlocking for separating the two toolboxes.

With reference to FIGS. 6 and 6A, when it is desired to separate the upper and lower first toolboxes 1, the user presses the pressing portion 146 of each snap fastener 14 of the lower first toolbox 1 to flex the engagement plate 141, disengaging the hooking face 144 of each snap fastener 14 from the engagement edge 151 of the corresponding engagement portion 15 of the upper first toolbox 1. Thus, the upper and lower first toolboxes 1 can be separated easily. Furthermore, as mentioned above, the upper first toolbox 1 can easily be stacked on the lower first toolbox 1 by moving the upper first toolbox 1 downwards to rest on top of the lower first toolbox 1 while the snap fasteners 14 of the upper first toolbox 1 automatically engage with the engagement portions 15 of the lower first toolbox 1. The operation is easy and convenient. Furthermore, the snap fasteners 14 are integrally formed with the first toolbox 1 without assembly of pivotal elements, reducing the number of elements and the manufacturing costs.

It can be appreciated that the snap fasteners 14 can be provided on the longitudinal sides 16 if desired. Furthermore, the first toolbox 1 can be of any other shape including a peripheral side including the snap fasteners 14 and the engagement portions 15.

Figure 7:
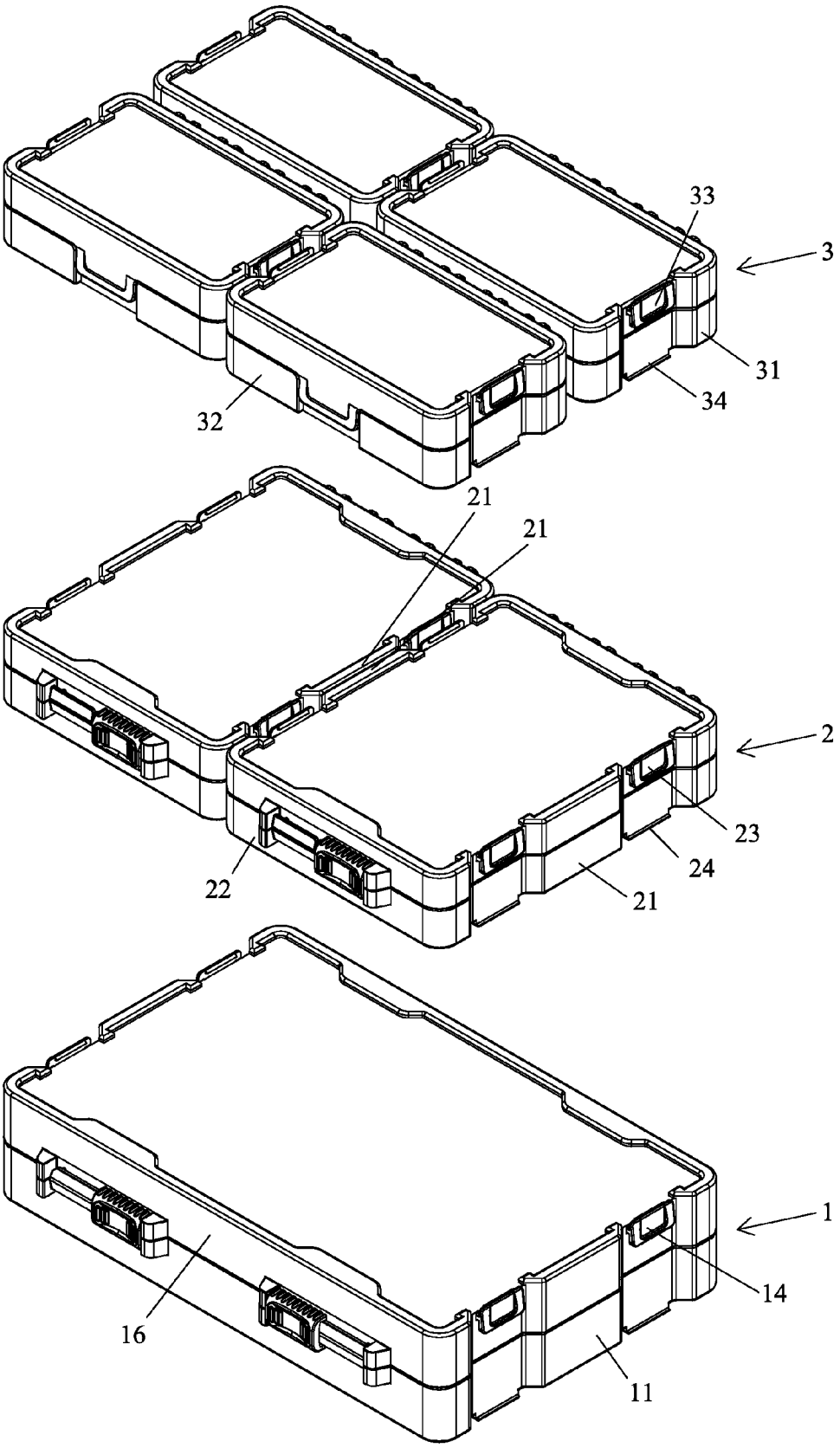
FIG. 7 is a perspective view of toolboxes of different sizes according to the present invention.
Figure 8:
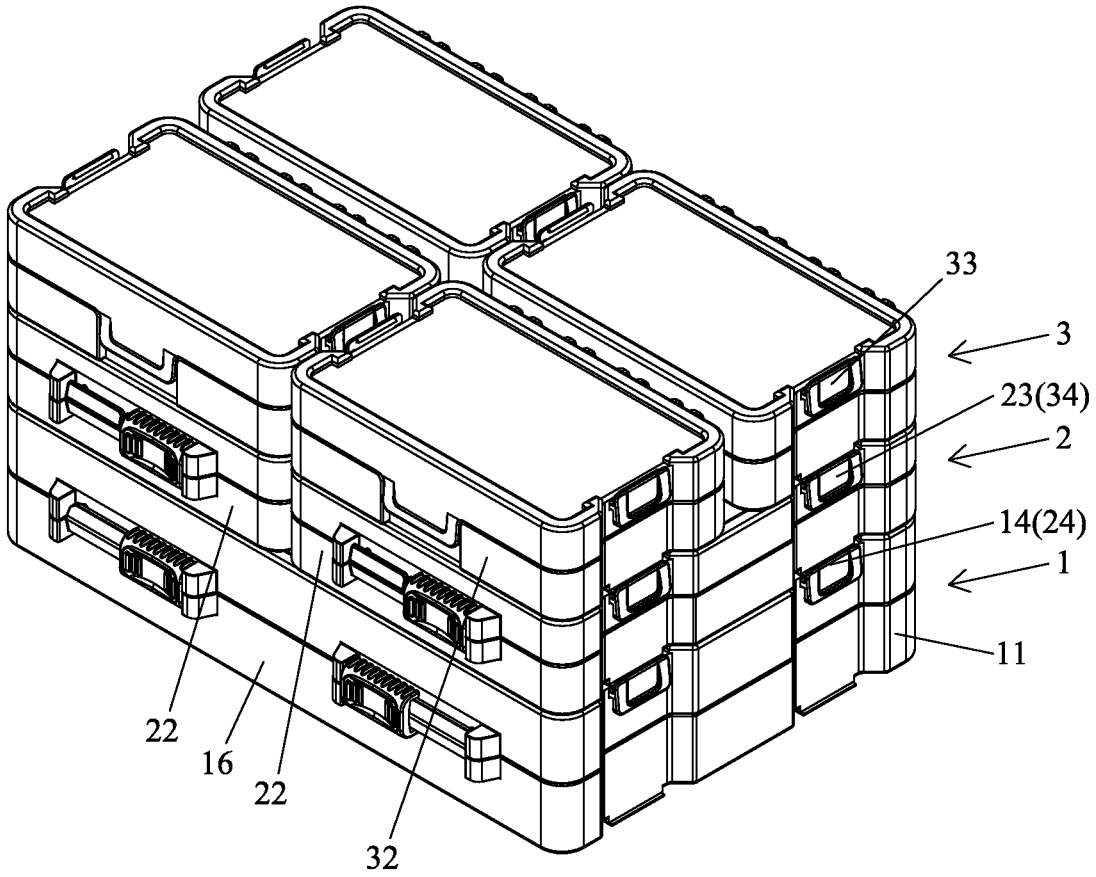
FIG. 8 is a perspective view of the toolboxes of FIG. 7 after stacking.

Toolboxes of different sizes according to the present invention can be stacked. Smaller toolboxes can be stacked on the first toolbox 1. In an example shown in FIGS. 7 and 8, a toolbox set according to the present invention includes a first toolbox 1, two second toolboxes 2, and four third toolboxes 3. Each second toolbox 2 is substantially a parallelepiped and includes two longitudinal sides 21 and two lateral sides 22. Each longitudinal side 22 of each second toolbox 2 has a length equal to the length of each lateral side 11 of the first toolbox 1. Each lateral side 21 of each second toolbox 2 has a length equal to a half of the length of each longitudinal side 16 of the first toolbox 1. Each longitudinal side 21 of each second toolbox 2 includes two snap fasteners 23 on an upper end thereof and two engagement portions 24 on a lower end thereof. The snap fasteners 23 of each second toolbox 2 are substantially the same as the snap fasteners 14 of the first toolbox 1. The engagement portions 24 of each second toolbox 2 are substantially the same as the engagement portions 15 of the first toolbox 1. The top side of each second toolbox 2 can include at least one at least one abutment portion substantially the same as the at least one abutment portion 161. The bottom side of each second toolbox 2 can include at least one at least one protrusion substantially the same as the at least one protrusion 131.

The two second toolboxes 2 are placed side by side and are stacked on top of the first toolbox 1. Each engagement portion 24 of each second toolbox 2 engages with one of the snap fasteners 14 of the first toolbox 1. Two adjacent lateral sides 21 of the two second toolboxes 2 abut each other. Thus, the two second toolboxes 2 are securely stacked on top of the first toolbox 1.

Each third toolbox 3 is substantially a parallelepiped and includes two lateral sides 31 and two longitudinal sides 32. Each longitudinal side 32 of each third toolbox 3 has a length equal to the length of each lateral side 22 of each second toolbox 2. Each lateral side 31 of each third toolbox 3 has a length equal to a half of the length of each longitudinal side 21 of each second toolbox 2. Each lateral side 31 of each third toolbox 3 includes a snap fastener 33 on an upper end thereof and an engagement portion 34 on a lower end thereof. The snap fastener 33 of each third toolbox 3 is substantially the same as the snap fasteners 14 and 23 of the first and second toolboxes 1 and 2. The engagement portion 34 of each third toolbox 3 is substantially the same as the engagement portions 15 and 24 of the first and second toolboxes 1 and 2. The top side of each third toolbox 3 can include at least one at least one abutment portion substantially the same as the at least one abutment portion 161. The bottom side of each third toolbox 3 can include at least one at least one protrusion substantially the same as the at least one protrusion 131.

The four third toolboxes 3 are stacked on top of the second toolboxes 2. Two third toolboxes 3 are stacked on one of the second toolboxes 2, and the other two third toolboxes 3 are stacked on the other second toolbox 2. The engagement portion 34 of each third toolbox 3 engages with one of the snap fasteners 23 of a corresponding second toolbox 2. Two adjacent longitudinal sides 32 of two third toolboxes 3 stacked on the same second toolbox 2 abut each other. Thus, the four third toolboxes 3 are securely stacked on top of the two second toolboxes 2. It can be appreciated that the toolbox set according to the present invention can have different numbers of toolboxes of differing sizes to meet various needs, providing wide applications.

In view of the foregoing, the toolboxes according to the present invention can be stacked easily and conveniently, have simple simples, and can be assembled in various manners.

Although specific embodiments have been illustrated and described, numerous modifications and variations are still possible without departing from the scope of the invention. The scope of the invention is limited by the accompanying claims.

The invention claimed is:

1. A toolbox set comprising a first toolbox and two second toolboxes, with each of the first toolbox and the two second toolboxes including a space adapted for receiving tools, with each of the first toolbox and the two second toolboxes including two lateral sides, two longitudinal sides, and top and bottom sides, with each of the two longitudinal sides of each of the two second toolboxes having a length equal to a length of each of the two lateral sides of the first toolbox, and with each of the two lateral sides of each of the two second toolboxes having a length equal to a half of a length of each of the two longitudinal sides of the first toolbox, with each of the two lateral sides of the first toolbox including two first snap fasteners on an upper end thereof and two first engagement portions on a lower end thereof, with each of the longitudinal sides of each of the two second toolboxes including two second snap fasteners on an upper end thereof and two second engagement portions on a lower end thereof, with each of the two first snap fasteners and the two second snap fasteners including an engagement plate, with a hook formed on an upper end of the engagement plate and protruding towards a corresponding one of the two lateral boxes of the first toolbox or a corresponding one of the two longitudinal sides of one of the two second toolboxes, with the hook including a top having an inclined guiding face and a bottom having a hooking face, with a connecting plate provided on an intermediate portion of an inner face of the engagement plate and connected to a corresponding one of the two lateral sides of the first toolbox or a corresponding one of the two longitudinal sides of one of the two second toolboxes, with the engagement plate spaced from a corresponding one of the two lateral boxes of the first toolbox or a corresponding one of the two longitudinal sides of one of the two second toolboxes and flexible about the connecting plate, with the engagement plate further including a lower end having a pressing portion, with the pressing portion adapted to be pressed to move the hook away from a corresponding one of the two lateral sides of the first toolbox or a corresponding one of the two longitudinal sides of one of the two second toolboxes, with each of the two first engagement portions and the two second engagement portions including an engagement edge protruding away from a corresponding one of the first toolbox or a corresponding one of the two second toolboxes, with the two second toolboxes stacked on the first toolbox, with the hook face of the hook of each of the two first snap fasteners of the first toolbox engaged with the engagement edge of one of the two second engagement portions of one of the two second toolboxes stacked above the first toolbox, and with two adjacent lateral sides of the two second toolboxes abutting each other.

2. The toolbox set as claimed in claim 1, further comprising: four third toolboxes, with each of the four third toolboxes including a space adapted for receiving tools, with each of the four third toolboxes including two lateral sides, two longitudinal sides, and top and bottom sides, with each of the two longitudinal sides of each of the four third toolboxes having a length equal to the length of each of the two lateral sides of each of the two second toolboxes, and with each of the two lateral sides of each of the four third toolboxes having a length equal to a half of the length of each of the two lateral sides of each of the two second toolboxes, with each of the two lateral sides of each of the four third toolboxes including a third snap fastener on an upper end thereof and a third engagement portion on a lower end thereof, with each third snap fastener including an engagement plate, with a hook formed on an upper end of the engagement plate of each third snap fastener and protruding towards a corresponding one of the two lateral boxes of one of the four third toolboxes, with the hook of each third snap fastener including a top having an inclined guiding face and a bottom having a hooking face, with a connecting plate provided on an intermediate portion of an inner face of the engagement plate of each third snap fastener and connected to a corresponding one of the two lateral sides of one of the four third toolboxes, with the engagement plate spaced from a corresponding one of the two lateral boxes of one of the four third toolboxes, with the engagement plate of each third snap fastener further including a lower end having a pressing portion, with the pressing portion of each third snap fastener adapted to be pressed to move the hook of the third snap fastener away from a corresponding one of the two lateral sides of one of the four third toolboxes, with each of the two engagement portions including an engagement edge protruding away from the toolbox, with two of the four toolboxes stacked on one of the two second toolboxes, with two adjacent longitudinal sides of the two of the four toolboxes abutting each other, with another two of the four toolboxes stacked on another of the two second toolboxes, with two adjacent longitudinal sides of the another two of the four toolboxes abutting each other, and with the hook face of the hook of each of the two second snap fasteners of each of the two second toolboxes engaged with the engagement edge of the engagement portion of one of the four third toolboxes.

* * * * *